United States Patent [19]

Fujie et al.

[11] 4,134,444

[45] Jan. 16, 1979

[54] AUTOMATIC MOLTEN METAL POURING APPARATUS

[75] Inventors: Masakatsu Fujie, Ushikumachi; Kazuo Honma, Amimachi; Atsushi Matsuzaki, Tokyo, all of Japan

[73] Assignee: Hitachi, Ltd., Japan

[21] Appl. No.: 703,237

[22] Filed: Jul. 7, 1976

[30] Foreign Application Priority Data

Oct. 29, 1975 [JP] Japan ..... 50-129228

[51] Int. Cl.[2] ..... B22D 11/16

[52] U.S. Cl. ..... 164/155

[58] Field of Search ..... 164/4, 155, 150; 250/222 R, 577; 73/290 R, 293; 33/1 N, 1 PT, 267

[56] References Cited

U.S. PATENT DOCUMENTS

| | | | |
|---|---|---|---|
| 1,955,315 | 4/1934 | Styer | 250/577 X |
| 2,586,713 | 2/1952 | Ratcliffe et al. | 164/155 |
| 2,836,894 | 6/1958 | Wagner | 33/267 |
| 3,122,800 | 3/1964 | Naffziger | 164/155 |
| 3,293,705 | 12/1966 | Lenz et al. | 164/155 |
| 3,343,591 | 9/1967 | Lorang | 164/155 |
| 3,818,971 | 6/1974 | Schutz | 164/155 X |

FOREIGN PATENT DOCUMENTS

| | | | |
|---|---|---|---|
| 2548750 | 4/1976 | Fed. Rep. of Germany | 164/155 |

*Primary Examiner*—Francis S. Husar
*Assistant Examiner*—John S. Brown
*Attorney, Agent, or Firm*—Craig & Antonelli

[57] ABSTRACT

Automatic molten metal pouring apparatus comprising molten metal level detector, mold position detector, ladle tilting angle detector, a ladle tilting servomechanism and a control device. The apparatus permits a suitable pouring flow rate of molten metal to be automatically poured into each of the molds of different types which may be conveyed one after another to the pouring position along the casting line.

20 Claims, 13 Drawing Figures

(a)

(b)

(a)

(b)

AUTOMATIC MOLTEN METAL POURING APPARATUS

BACKGROUND OF THE INVENTION

This invention relates to automatic molten metal pouring apparatus capable of automatically causing the ladle to pour a suitable pouring flow rate of molten metal into each of the molds of different types. In general practice, the invention can have application in cases where it is required to automatically pour any liquid in different quantities into vessels of different sizes.

The present practice in the metal casting industry is only to provide a ladle with a mechanism for tilting the ladle through a predetermined angle at all times, so that the ladle can be titled to feed molten metal to the cavities of the molds conveyed along casting line. Thus when molds of different cavity sizes which require different pouring flow rates of molten metal to be fed to the cavities thereof are conveyed along the casting line, it has hitherto been customary to adjust the tilting angle of the ladle beforehand in such a manner that the mechanism is set at a ladle tilting angle which suits the mold cavity of the largest size. As a result, a large pouring flow rate of molten metal has hitherto been fed to a mold cavity requiring a small pouring flow rate of molten metal to be poured thereinto. Moreover, since the position of the lip of a ladle may vary depending on the tilting angle of the ladle, it has hitherto been required to increase, more than is necessary, the size of a pouring cup at the head of a sprue or downgate (including a pouring basin which receives and temporarily collects therein the poured molten metal for removing slag and other foreign matter therefrom). These factors have been responsible for the low yield of the castings. The temperature of the molten metal poured into and collected in the pouring cup becomes lower with time. Thus, an increase in the size of the pouring cup has hitherto caused a degradation of the quality of the castings produced.

SUMMARY OF THE INVENTION

This invention has as its object the provision of automatic molten metal pouring apparatus capable of pouring a necessary quantity of molten metal into each mold when molds of different types requiring different pouring flow rates of molten metal to be fed to the cavities thereof are conveyed along the casting line, whereby the yield and the quality of the castings produced can be increased.

In accordance with the present invention, there is provided an automatic molten metal pouring apparatus comprising molten metal level detector means for detecting the level of the molten metal collected in a pouring cup or an ancillary pouring cup, mold position detector means for detecting that a mold has reached a suitable position, ladle tilting angle detector means, a ladle tilting servomechanism for tilting a ladle, and a control device receiving signals from the molten metal level detector means and the mold position detector means for actuating the ladle tilting servomechanism upon receipt of such signals for effecting control of molten metal pouring operation. The apparatus enables molten metal to be automatically poured in a suitable quantity into the cavity of each mold.

DESCRIPTION OF THE PREFERRED EMBODIMENTS

Figure 1:
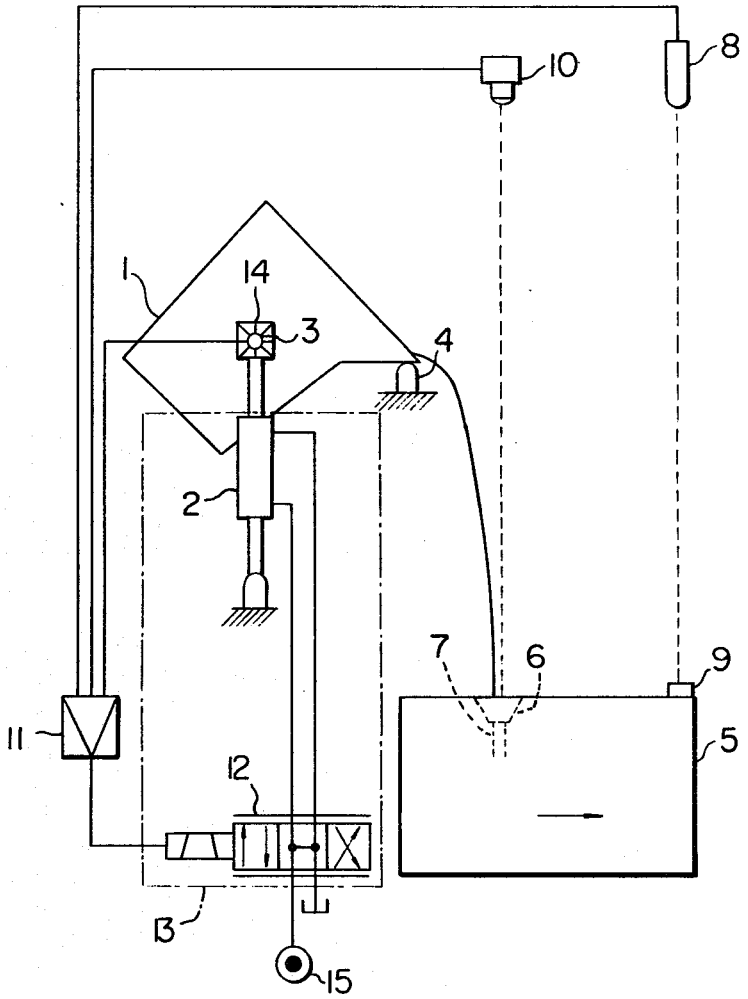
FIG. 1 is a schematic view of the automatic molten metal pouring apparatus comprising one embodiment of this invention.

FIG. 1 shows in a schematic view the automatic molten metal pouring apparatus comprising one embodiment of this invention. As shown, a ladle 1 which is supported by a rotary shaft 3 is adapted to be caused to tilt by the telescopic movement of a piston 2. When the ladle 1 moves in tilting motion, it is supported at a fulcrum 4. A mold 5 which includes a pouring cup 6 and a sprue or downgate 7 is adapted to be conveyed in the direction of the arrow. A mark detector 8 is adapted to identify a mark 9 superposed on the mold when the mark 9 has reached a suitable position. A molten metal level detector 10 is adapted to detect the molten metal level in the pouring cup 6. A control device 11 which has a data memory mounted therein is connected to a servo-valve 12 in a manner to control opening and closing of the latter. The piston 2 and the servo-valve 12 constitute a ladle tilting servomechanism 13. A ladle tilting angle detector 14 which is mounted on the rotary shaft 3 or a support (not shown) is adapted to detect the tilting angle of the ladle 1. Signals from the mark detector 8, molten metal level detector 10 and ladle tilting angle detector 14 are inputed to the control device 11, while the servo-valve 12 supplies pressurized oil from a pressurized oil source 15 to the piston 2.

The operation of the apparatus constructed as aforesaid will now be described. First, the mold position detector means, which may be referred to as pouring cup position detector means, is rendered operative. More specifically, when the mold 5 has reached a suitable position, the mark detector 8 identifies the mark 9 and detects that the mold 5 has been placed in the suitable position. The mark detector 8 thus produces a signal which is supplied to the control device 11 as an input. Upon receipt of this signal, the control device 11 supplies a signal to the servo-valve 12 so as to cause the ladle 1 to tilt, with a result that the servo-valve 12 supplies pressurized oil to the piston 2 and causes the same to move in telescopic motion to make the ladle 1 tilt. Thus, the molten metal is poured into the pouring cup 6. The molten metal level in the pouring cup 6 is detected by the molten metal level detector 10. When the molten metal level becomes higher than a predetermined level, a signal is supplied to the control device 11 and servo-valve 12, so that the servo-valve 12 is actuated in a manner to reduce the quantity of pressurized oil supplied to the piston 2. Conversely, when the molten metal level is lower than the predetermined level, the servo-valve 12 is actuated in a manner to increase the tilting angle of the ladle 1 by supplying an increased quantity of pressurized oil to the piston 2. Thus, the molten metal level in the pouring cup 6 can be maintained at an optimum level at all times.

Upon completion of feeding of the molten metal, the ladle 1 is restored to its original tilting position, and the mold 5 is moved (forwardly) in the direction of the arrow. The angle through which the ladle 1 has tilted when feeding of the molten metal is completed is stored in the data memory of the control device 11. Thus, when the molten metal is poured into the next following mold, the ladle is tilted quickly until the tilting angle at which the previous pouring operation is completed is reached, and thereafter further tilting of the ladle 1 is controlled in such a manner that tilting movement takes place at a suitable speed.

Figure 2:
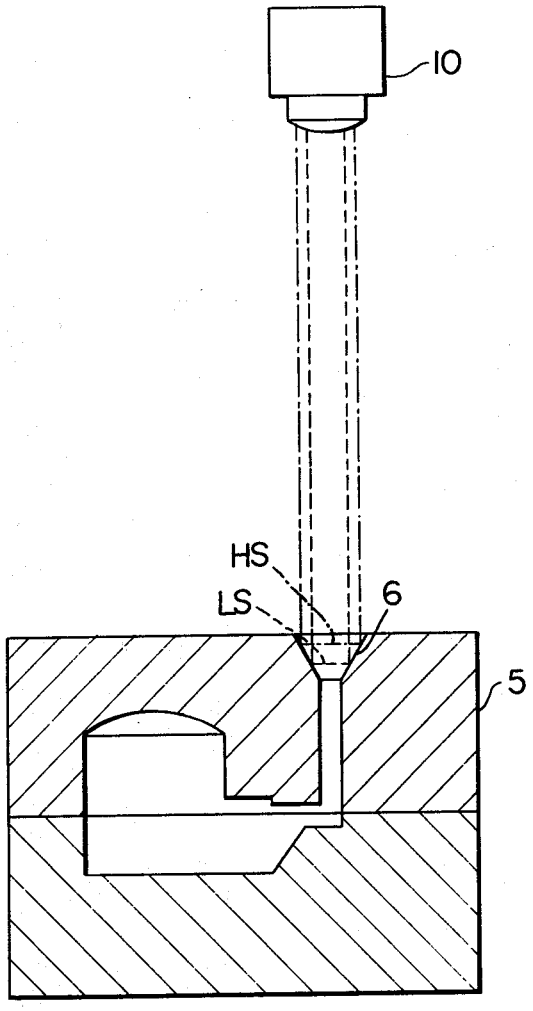
FIG. 2 is a view in explanation of one form of molten metal level detector means.

The molten metal level detector means will be described in detail with reference to FIG. 2. As shown, the molten metal level detector 10 is disposed immediately above the pouring cup 6 whose form is conical. There are established two molten metal levels: One is a lower lever LS and the other is a higher level HS. The molten metal level detector 10 has a light receiving surface of a substantial area which generates a photoelectric current of a value which is proportional to the area of light incident on the light receiving surface. Thus, the area of light incident on the light receiving surface of the molten metal level detector 10 will undergo changes as the volume of light emanating from the molten metal in the pouring cup varies, as the molten metal level changes from the lower level LS to the higher level HS. This causes variations in the value of the photoelectric current generated by the light receiving surface of the detector 10. It is possible to detect the molten metal level on the basis of the value of the photoelectric current generated by the light receiving surface of the detector 10.

Figure 3:
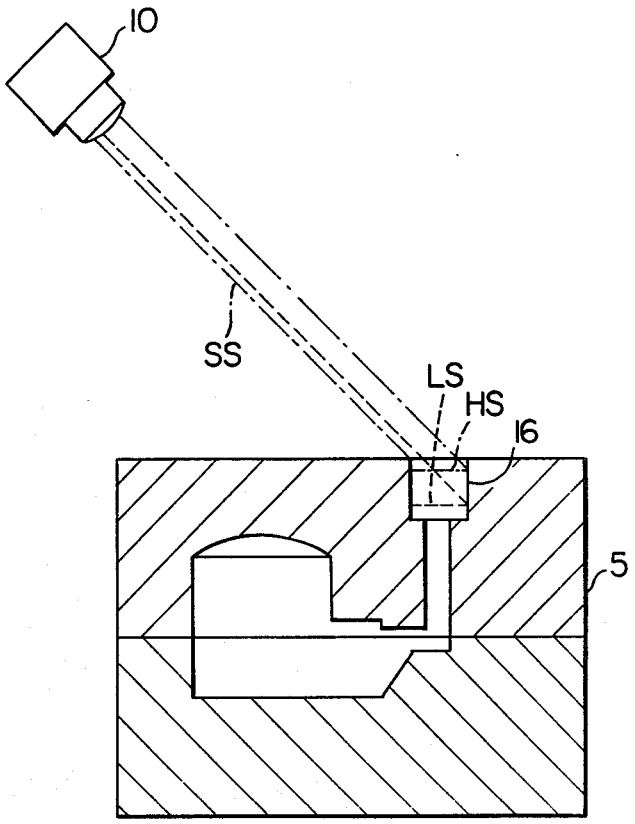
FIG. 3 is a view in explanation of another form of molten metal level detector means.

FIG. 3 shows another form of molten metal level detector means, wherein the molten metal level detector 10 is disposed obliquely with respect to a pouring cup 16. The pouring cup 16 is square in vertical cross-sectional shape, with its walls being disposed vertically. The pouring cup 16 has two molten metal levels or a lower level LS and a higher level HS. The molten metal level in the pouring cup 16 can be determined on the basis of the value of the photoelectric current which may vary depending on the area of light emanating from the molten metal which is disposed between the lower level LS or the higher level HS and a reference level SS.

In the mold position detector means, the mark 9 superposed on the mold 5 can be identified if the mark is an object which is much brighter than the surface of the mold 5. For example, the mark 9 may be in the form of a reflector mounted on the mold 5 in such a manner that the light reflected by the reflector is incident on the mark detector 8 while the mold 5 is being conveyed along the casting line. If means is provided whereby the reflector mounted on the mold, into which molten metal has been poured, can be brought to an inoperative position, it will be possible to readily distinguish those molds which have already received a supply of molten metal from those molds which have not yet received molten metal. Besides, it is possible to use a strainer which is inserted into each pouring cup. The strainer is made of a material which is much brighter than the surface of the mold, so that the light reflected by the strainer alone will be incident on the mark detector 8. By adopting any one of these means, it is possible to detect the arrival of the mold 5 at a suitable position and hence to cause the mold 5 to stop in such position.

When the molten metal is poured from the ladle 1 into the mold 5, an increase in the tilting angle of the ladle 1 results in the locus of a stream of poured molten metal shifting forwardly (or further away from the ladle 1).

Figure 4:
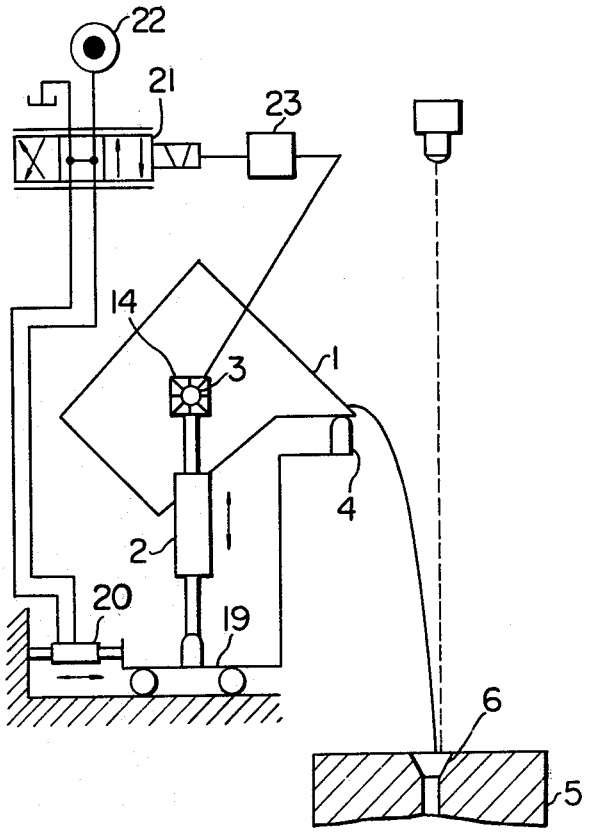
FIG. 4 is a schematic view of one form of device for moving the ladle in a horizontal direction.

To cope with this situation, a proposal is made to use a device shown in FIG. 4 for moving the ladle 1 rearwardly as the tilting angle thereof increases. By using this ladle moving device, it is possible to positively pour the molten metal into the pouring cup 6 and hence to reduce the size of the pouring cup 6. More specifically, the ladle moving device shown in FIG. 4 comprises a truck 19 on which the ladle is placed. The ladle tilting angle detector 14 is mounted on the rotary shaft 3 or the ladle 1 and produces signals which represent the tilting angles of the ladle 1 as aforesaid. The ladle moving device also includes a compensating piston 20 which is adapted to move the ladle 1 in a horizontal direction by its telescopic movement. A servo-valve 21 is mounted on a line connecting the compensating piston 20 to a pressurized oil source 22. Horizontal movement control means 23 is interposed between the ladle tilting angle detector 14 and servo-valve 21 and adapted to open or close the servo-valve 21 upon receipt of signals from the ladle tilting angle detector 14.

The ladle moving device shown in FIG. 4 and described hereinabove operates as follows. The ladle 1 is caused to tilt during a molten metal pouring operation, and the tilting angle thereof is detected by the ladle tilting angle detector 14. The result is inputed to the horizontal movement control means 23 which either opens or closes the servo-valve 21. The pressurized oil is supplied from the pressurized oil source 22 to the compensating piston 20 through the servo-valve 21 in its open position. This causes the truck 19 supporting the ladle 1 thereon to move in such a manner that the ladle 1 is shifted horizontally to a preset position which is commensurate with the detected tilting angle of the ladle 1.

Figure 5:
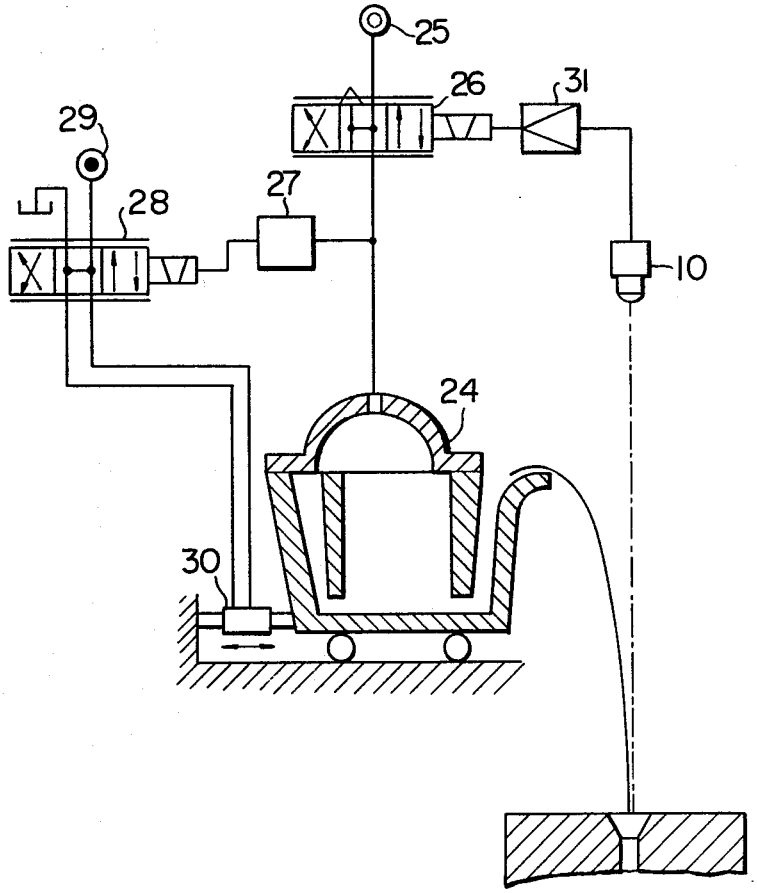
FIG. 5 is a schematic view of another form of device for moving the ladle in a horizontal direction.

FIG. 5 shows another form of device for horizontally moving the ladle 1. The ladle 1 shown in FIG. 4 is caused to tilt by the telescopic movement of the piston 2. In the embodiment shown in FIG. 5, a pot-type ladle 24 is used and the pressure applied to the interior of the ladle 24 is adjusted by means of a pneumatic pressure servo-valve from a pneumatic pressure source 25. The locus of a stream of poured molten metal which may vary depending on the pressure applied to the interior of the ladle 24 is detected, and a hydraulic pressure servo-valve 28 is actuated by horizontal movement control means 27 in a manner to render operative a compensating piston 30 by supplying pressurized oil from a pressurized oil source 29, whereby the ladle 24 can be moved horizontally to a correct position. The pneumatic pressure servo-valve 26 is opened or closed by pouring flow rate control means 31 after the molten metal level in the pouring cup is detected by the molten metal level detector 10.

Figure 6:
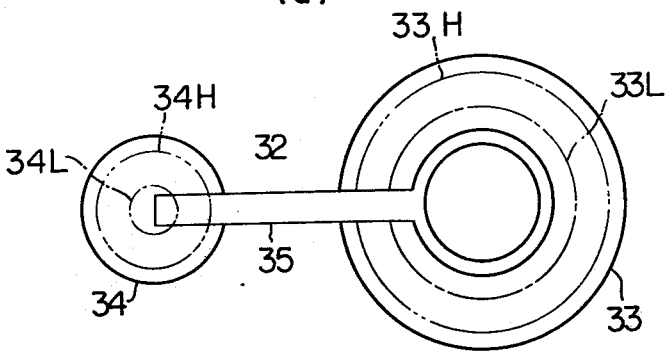
FIG. 6 is a view in explanation of a modified form of pouring cup.
Figure 6:
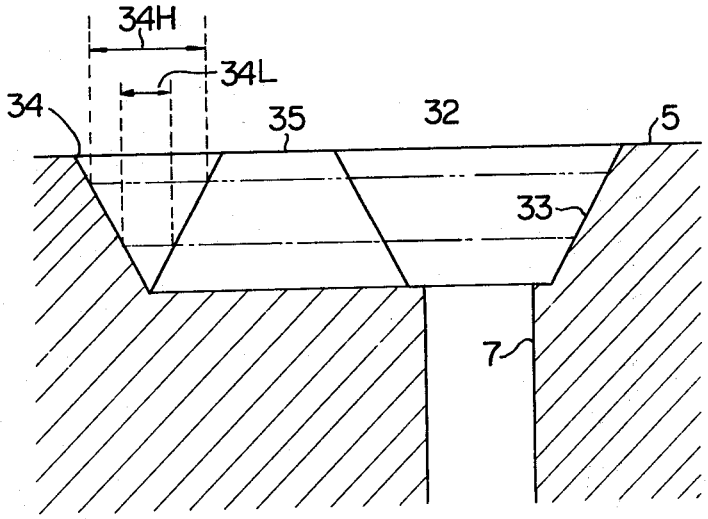

FIG. 6 (*a*) and FIG. 6 (*b*) show pouring cup means comprising a main pouring cup and an ancillary pouring cup to facilitate detection of the molten metal level. FIG. 6 (*a*) is a plane view of the pouring cup means, while FIG. 6 (*b*) is a vertical sectional view thereof. As shown, the pouring cup means 32 comprises the main pouring cup 33 and the ancillary pouring cup 34 disposed in close proximity to the main pouring cup 33, the main and ancillary pouring cups 33 and 34 being both conical in form. The main pouring cup 33 and the ancillary pouring cup 34 communicate with each other through a communicating passage 35, of a width which is smaller than the largest diameter portion of either the main pouring cup 33 or the ancillary pouring cup 34.

If molten metal is poured into the main pouring cup 33, the molten metal will run through the downgate 7 into the cavity of the mold and at the same time will flow into the ancillary pouring cup 34 through the communicating passage 35. Since the molten metal is continuously poured, the surface of the molten metal in the main pouring cup 33 is agitated and disturbed at all times, but the surface of the molten metal in the ancillary pouring cup 34 is not agitated and remains undisturbed. Fluctuations in the molten metal level in the main pouring cup 33 will cause the molten metal level in the ancillary pouring cup 34 to fluctuate in like manner. Thus, by watching the molten metal level in the ancillary pouring cup 34, it is possible to feed a suitable pouring flow rate of molten metal to the cavity of each mold.

More specifically, a fluctuation in the molten metal level manifests itself as an increase or a decrease in the area of the surface of the molten metal. When there is a small quantity of molten metal in the main pouring cup 33, its level is a lower level 33L: when there is A a large quantity of molten metal, its level is an upper level 33H. The lower level 33L and the higher level 33H correspond to a lower level 34L and a higher level 34H respectively in the ancillary pouring cup 34. In the event that the mold 5 is a sand mold, for example, the molten metal in the ancillary pouring cup 34 will be very bright in contrast to the mold surface which is dark if watched from above. Thus, a rise or a fall in the molten metal level manifests itself as an increase or a decrease in the area of the surface of the molten metal in the ancillary pouring cup 34.

Figure 7:
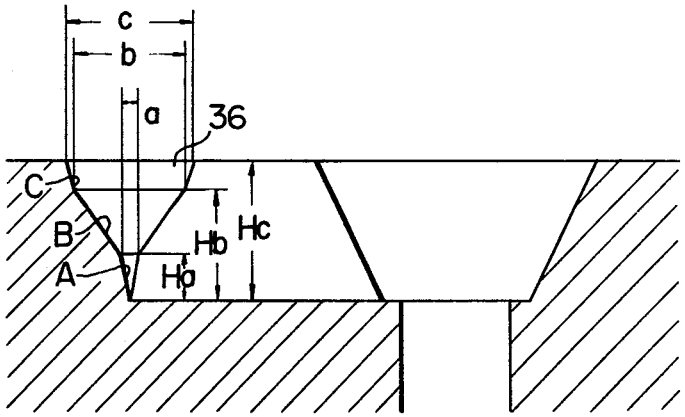
FIG. 7 is a view in explanation of another modified form of pouring cup.
Figure 8:
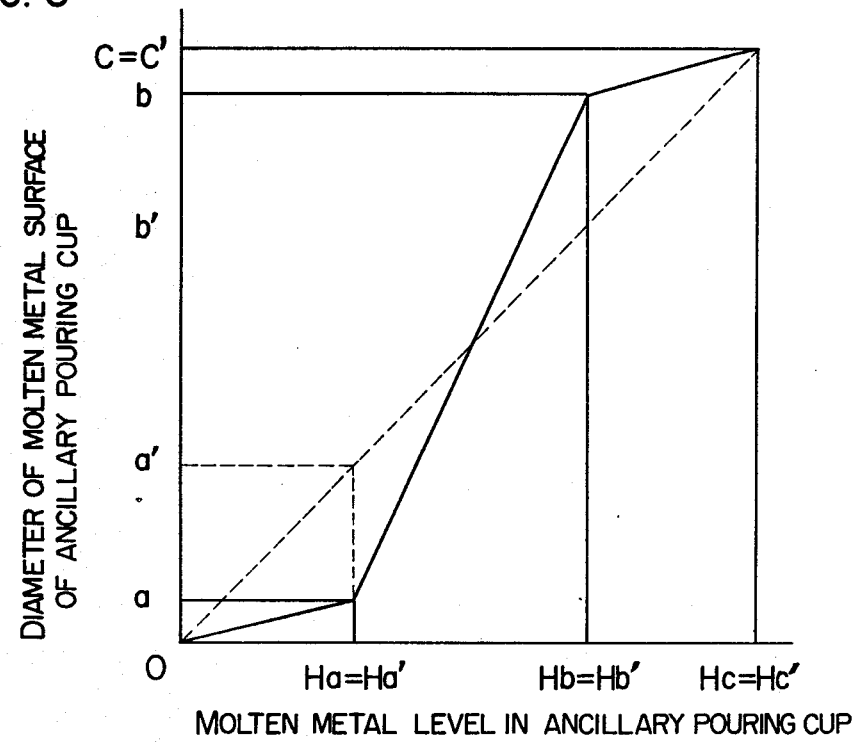
FIG. 8 is a graph showing the relationship between the height of the molten level and the diameter of the surface of the molten metal of the ancillary pouring cup shown in FIG. 7.

By effectively utilizing the wall of the conical ancillary pouring cup, it is possible to detect the molten metal level with a high degree of accuracy. More specifically, the ancillary pouring cup is constructed such that the tapering wall of the substantially conical ancillary pouring cup is divided into several wall portions of different degrees of inclination or lower, intermediate and upper wall portions, as shown in FIG. 7. The lower wall portion is designated by A, the intermediate wall portion by B and the upper wall portion by C, all the wall portions differing from one another in the degree of inclination. The largest diameter portions of the wall portions A, B and C of different degrees of inclination are designated by a, b and c respectively. The intermediate wall portion B is less sharply inclined than the lower wall portion A and the upper wall portion C. With the intermediate wall portion B being more gently inclined or sloped than the rest of the wall portions, a small change in the molten metal level causes a great change in the diameter of the surface of the molten metal in the intermediate wall portion B. This fact will be described with reference to FIG. 8 in which the molten metal levels set forth along the horizontal axis are plotted against the diameters of the surfaces of the molten metal in the ancillary pouring cup. In the case of the ancillary pouring cup shown in FIG. 6, when the molten metal level changes from Ha' to Hb', the diameter of the surface of the molten metal only changes from a' to b' (shown in broken lines). However, in the case of the ancillary pouring cup shown in FIG. 7, the diameter of the surface of the molten metal changes from a to b (shown in solid lines). The inclinations or slopes can be expressed as follows:

$$\frac{b' - a'}{Hb' - Ha'} < \frac{b - a}{Hb - Ha}$$

It will be seen that, when the change shown by the molten metal level is identical, the ancillary pouring cup of FIG. 7 shows a greater change in the diameter of the surface of the molten metal than the ancillary pouring cup of FIG. 6.

Figure 9:
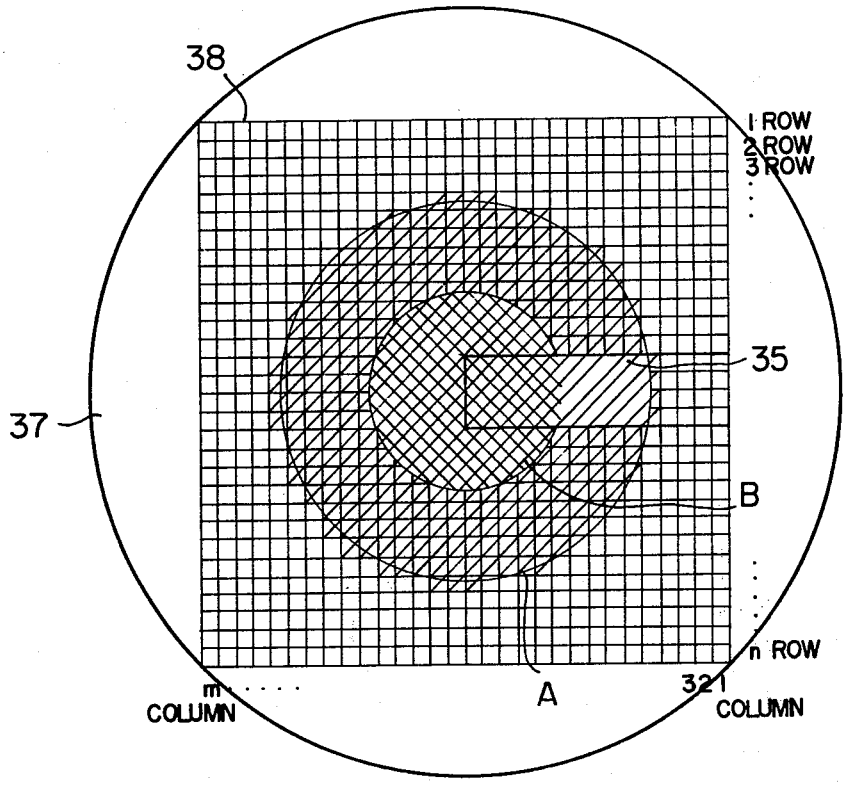
FIG. 9 is a view in explanation of the light receiving section of the molten metal level detector means.

When a casting operation is performed under circumstances such that there are changes in the casting conditions caused by smoke or dust from time to time, the molten metal level can be measured with increased accuracy by constructing the light receiving surface of the molten metal level detector as shown in FIG. 9. As shown, a light receiving section 37 has a multitude of light receiving elements 38 arranged in a primary plane. The molten metal level is indicated by the area of the surface of the molten metal. Thus, when the molten metal level is high, the light receiving section will have a large effective area A; when it is low, the light receiving section will have a small effective area B. The size of the effective area determines the value of the electric current to which the size of the effective area of the light receiving surface is converted. That is, when the effective area is large in size, a current of large value will flow. The light receiving elements are arranged in a checkerboard pattern in n rows and m columns, so that their number is (n × m). Each of (n × m) elements responds to the brightness of light when the volume of light incident thereon exceeds a predetermined level.

The diameter of the surface of the molten metal can be measured with increased accuracy by tolerating the misalignment of the detector 10 with the pouring cup, if the following steps are followed. The number of the light receiving elements on which light of a volume exceeding a predetermined level is incident, of all the elements disposed between the first column and the first row and the first column and the nth row of the light receiving section 38, is calculated by a computer. Scanning of the light receiving elements is carried out repeatedly from the first column to the mth column, and the number of the light receiving elements of each column on which light of the volume exceeding the predetermined level is incident is calculated. The number of the light receiving elements of the column which has the largest number of light receiving elements on which light of the predetermined light volume is incident is used to determine the diameter of the surface of the molten metal. Since the diameter of the surface of the molten metal is proportional to the molten metal level, it is possible to readily determine the molten metal level by measuring the diameter of the surface of the molten metal.

Figure 10:
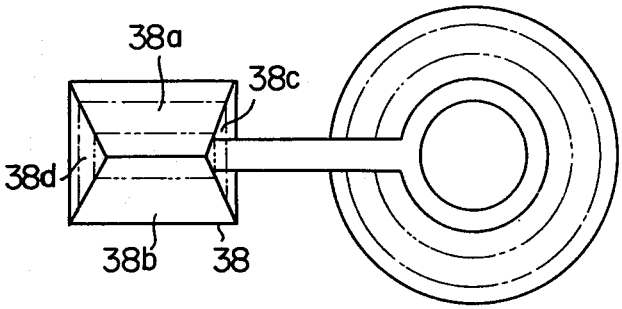
FIG. 10 is a view in explanation of the operation for detecting the molten metal level by using the ancillary pouring cup shown in FIG. 7.
Figure 10:
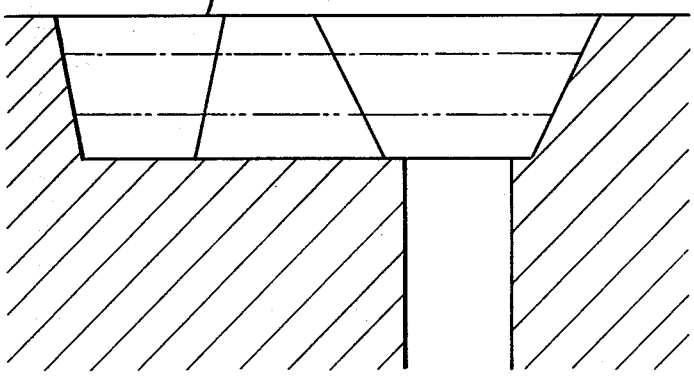

If an ancillary pouring cup of the shape down in FIG. 10 is used, it is possible to simplify the molten metal level detector means and to give broad tolerances to the alignment of the detector with the ancillary pouring cup. As shown, the ancillary pouring cup 38 is shaped such that it is rectangular in transverse cross-sectional shape and triangular in vertical cross-sectional shape. One pair of opposed side walls 38*a* and 38*b* are sharply inclined or sloped with respect to the bottom, while the other pair of opposed side walls 38*c* and 38*d* are gently sloped (substantially to the same degree as a draft) or disposed substantially vertically.

Figure 11:
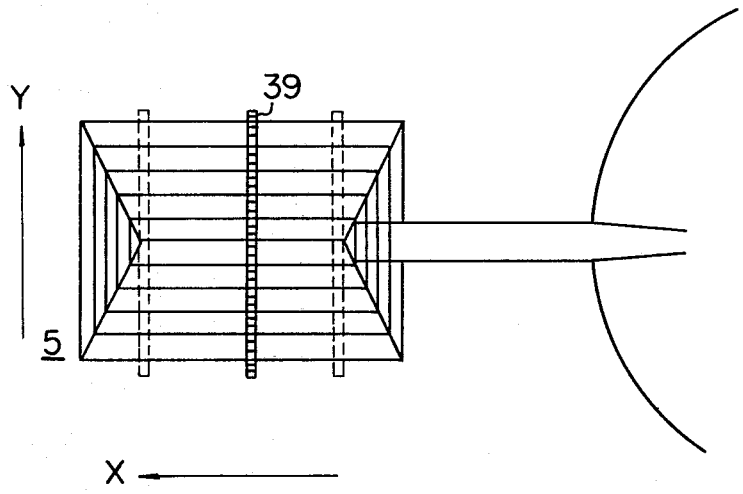
FIG. 11 is another view in explanation of the light receiving section of the molten metal level detector means.

By this arrangement, it is possible to indicate the molten metal level in terms of the width of the surface of the molten metal by means of a light receiving section 39 shown in FIG. 11. Even if the relative positions of the light receiving section 39 and the ancillary pouring cup are such that the former is displaced from its normal position in the X direction to a broken line position in the figure, it is possible to measure with a high degree of accuracy the width of the surface of the molten metal. A displacement of the light receiving section 39 in the Y direction can be compensated by increasing the number of the light receiving elements of the light receiving section 39.

Figure 12:
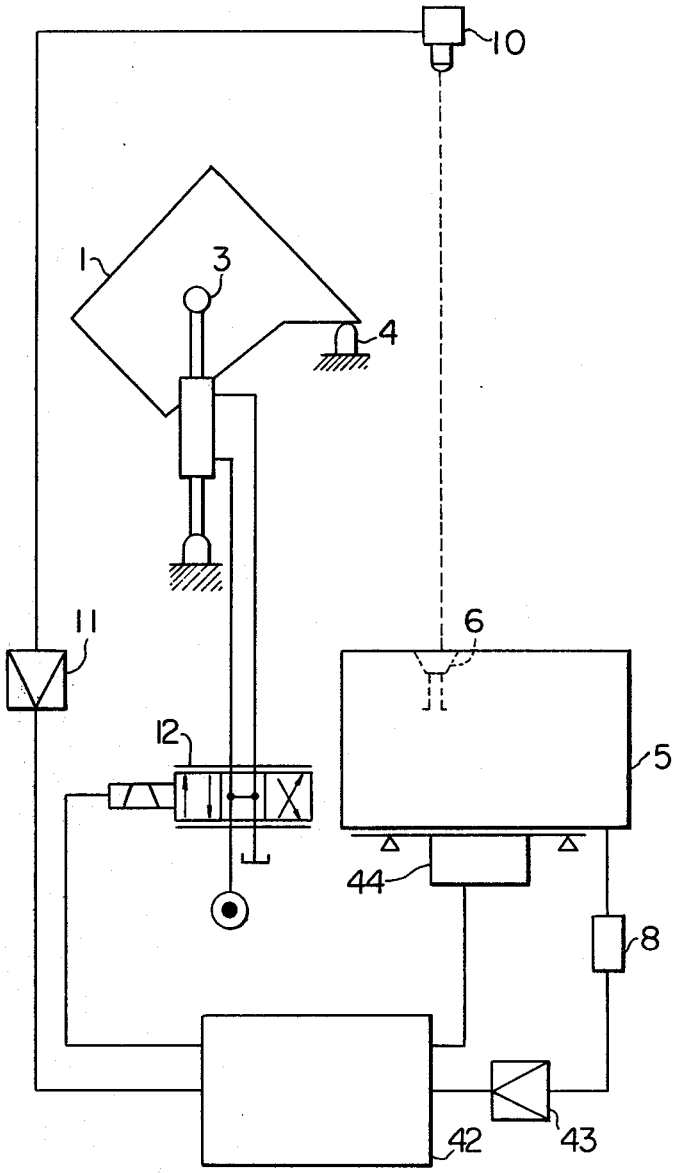
FIG. 12 is a schematic view of the automatic molten metal pouring apparatus comprising another embodiment of the invention.

FIG. 12 shows the automatic molten metal pouring apparatus comprising another embodiment of the invention which enables hunting of the pouring flow rate of molten metal poured into the mold to be minimized, and which predicts with accuracy the time of completion of pouring, thereby permitting pouring of molten metal to be stopped at a suitable time. As shown, an integrating control device 42 is interposed between the control device 11 and the servo-valve 12. The mark detector 8 identifies marks provided to molds of different types and supplies, through an amplifier 43 to the integrating control device 42, a signal which is consistent with the identified mark. A poured molten metal quantity detector 44, which is adapted to be rendered operative when the conveyed mold 5 stops at a predetermined position, calculates an integrated value of the pouring flow rate of molten metal and supplies a corresponding signal to the integrating control device 42.

Figure 13:
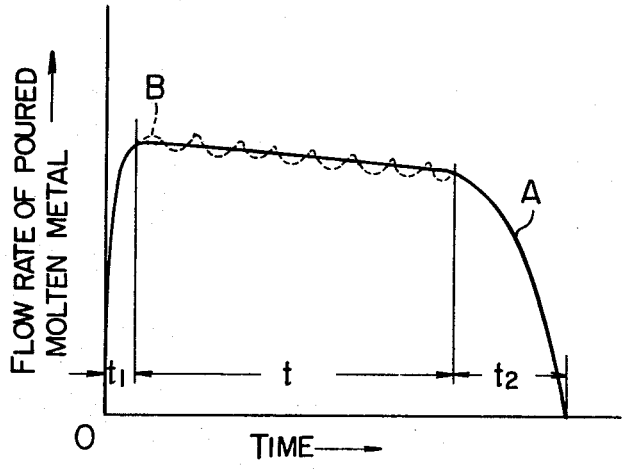
FIG. 13 is a graph showing the pouring flow rate of the molten metal poured into a mold in relation to time.

In operation, when the mold 5 stops at the suitable position, the mark detector 8 identifies the mark attached to the mold 5 and supplies a signal to the integrating control device 42. Upon receipt of the signal, the device 42 controls the tilting degree of the ladle 1 so that molten metal may be poured into the mold 5 in the manner described hereinafter. First, for a time interval of $t_1$, the molten metal is poured in a pouring flow rate which is an ideal pouring flow rate of molten metal to be poured into the particular mold 5, as indicated by a solid line curve A in FIG. 13. An ideal pouring flow rate is set for each type of mold. After lapse of the time interval $t_1$, feeding of the molten metal is carried out for a time interval t while the molten metal level is detected by the molten metal level detector 10, with a result that feeding of the molten metal is continued without the pouring flow rate of poured molten metal deviating greatly from the poured molten metal ideal pouring rate A as indicated by a broken line B. When the poured molten metal pouring rate detector 44 detects that the integrated value of the pouring rate of the poured molten metal has reached a predetermined level, pouring is continued for a time interval $t_2$, after lapse of the time intervals $t_1 + t$, in accordance with the predetermined pattern indicated by the solid line A. Separate molten metal pouring patterns are set for different types of molds and stored in the integrating control device 42.

We claim:

1. Automatic molten metal pouring apparatus comprising:

a. molten metal level detector means for detecting the level of molten metal remaining in a pouring cup;
b. mold position detector means for detecting that a mold has reached a predetermined position;
c. ladle tilting angle detector means for detecting the tilting angle of a ladle;
d. a ladle tilting servomechanism for causing said ladle to tilt; and
e. a control device receiving a supply of signals from said molten metal level detector means, said mold position detector means, and said ladle tilting angle detector means so as to actuate and control said ladle tilting servomechanism.

2. Automatic molten metal pouring apparatus comprising:

a. molten metal level detector means for detecting the level of said molten metal remaining in a pouring cup, said molten metal level detector means including a pouring cup or an ancillary pouring cup which is conical in form and a molten metal level detector disposed above said pouring cup or said ancillary pouring cup for detecting the molten metal level on the basis of the area of the surface of the molten metal;
b. mold position detector means for detecting that a mold has reached a predetermined position, said mold position detector means including a reflector provided on said mold, and a mark detector, said mold position detector means detecting that the mold has reached the suitable position on the basis of the volume of light reflected by said reflector;
c. ladle tilting angle detector means for detecting the tilting angle of a ladle, said ladle tilting angle detector means including a ladle tilting angle detector mounted on said ladle or a support for detecting the tilting angle of said ladle;
d. a ladle tilting servomechanism for causing said ladle to tilt, said ladle tilting servomechanism including a piston for causing said ladle to tilt, and a servo-valve adapted to supply pressurized oil to said piston or to interrupt the supply thereof; and
e. a control device receiving a supply of signals from said molten metal level detector means and said mold position detector means so as to actuate and control said ladle tilting servomechanism, said control device is adapted to receive a supply of signals from said molten level detector and said mark detector for actuating and controlling said ladle tilting servomechanism on the basis of said signals.

3. Automatic molten metal pouring apparatus as claimed in claim 2, wherein a signal of a magnitude proportional to the tilting angle of the ladle is supplied from said ladle tilting angle detector to said control device, and further comprising a compensating piston connected to a second servo-valve and adapted to move said ladle in a horizontal direction, said second servo-valve receiving an output signal of said control device and moves said ladle a distance commensurate with the tilting angle of said ladle in the horizontal direction.

4. Automatic molten metal pouring apparatus as claimed in claim 2, wherein an ancillary pouring cup is disposed in close proximity to a main pouring cup, said two pouring cups being conical in form and said two pouring cups being connected together, at least at their bottom portions, by a communicating passage of a width smaller than the largest diameter portion of either of the two pouring cups.

5. Automatic molten metal pouring apparatus as claimed in claim 2, wherein said mark detector comprises a light receiving section having a multitude of light receiving elements arranged in one plane.

6. Automatic molten metal pouring apparatus as claimed in claim 2, further comprising a poured molten metal quantity detector for detecting the integrated value of the pouring rate of poured molten metal, and an integrating control device adapted to receive a supply of signals from said molten metal level detector, said mark detector, said poured molten metal quantity detector and said ladle tilting angle detector, said integrating control device producing signals which actuate and control said ladle tilting servomechanism.

7. Automatic molten metal pouring apparatus as claimed in claim 6, further comprising an amplifier, and wherein said integrating control device effects control such that said servo-valve is opened and closed in accordance with a predetermined pouring pattern by signals from said control device, said amplifier and said poured molten metal quantity detector for intervals of time only at the initiating and terminating stages of a molten metal pouring operation, and the servo-valve is opened and closed by signals from said molten metal level detector during an interval of time other than the aforesaid intervals of time.

8. Automatic molten metal pouring apparatus comprising:

a ladle, a pouring cap formed on a mold, molten metal level detecting means disposed above the pouring cup for detecting a molten metal level in the pouring cup, ladle tilting means for tilting the ladle, means receiving signals from the molten metal level detecting means for controlling the ladle tilting means so as to change the rate of pouring molten metal in accordance with signals received from the molten metal level detecting means, and a ladle tilting angle detector means for detecting a tilting angle of the ladle and for supplying a signal of the ladle tilting angle to said controlling means, wherein the control means supplies a signal from the ladle tilting angle detector to the ladle tilting means so as to cause the ladle to tilt.

9. Automatic molten metal pouring apparatus as claimed in claim 8, further comprising:

means for shifting the ladle horizontally to a preset position which corresponds with a detected tilting angle of the ladle.

10. Automatic molten metal pouring apparatus as claimed in claim 1, wherein the pouring cup comprises a main pouring cup and an ancillary pouring cup, said ancillary pouring cup being conical in form and disposed in close proximity to the main pouring cup and communicating with the main pouring cup through a communicating means.

11. Automatic molten metal pouring apparatus as claimed in claim 10, wherein a conical wall of the ancillary pouring cup is divided into several wall portions with each of said wall portions having different degrees of inclination with respect to each other.

12. Automatic molten metal pouring apparatus as claimed in claim 1, wherein the pouring cup comprises a main pouring cup and an ancillary pouring cup, said ancillary pouring cup being rectangular in transverse cross-section and being disposed in close proximity to the main pouring cup, one pair of opposite side walls of said ancillary pouring cup being sharply inclined or sloped with respect to a bottom of the ancillary pouring cup as compared with the other pair of opposite side walls, and wherein communicating means are provided for communicating the main pouring cup with the ancillary pouring cup.

13. Automatic molten metal pouring apparatus as claimed in claim 1, wherein the molten metal level detecting means detects the molten metal level by detecting an area of a surface of the molten metal in the pouring cup.

14. Automatic molten metal pouring apparatus as claimed in claim 13, wherein the molten metal level detecting means is mounted in the pouring apparatus at an oblique angle with respect to the pouring cup.

15. Automatic molten metal pouring apparatus as claimed in claim 1, wherein the molten metal level detecting means comprises a plurality of light-receiving elements in which the molten metal level is indicated by an area of a surface of the molten metal in the pouring cup.

16. Automatic molten metal pouring apparatus as claimed in claim 1, wherein the ladle tilting means includes a servomechanism comprising a servo-valve and a piston.

17. Automatic molten metal pouring apparatus as claimed in claim 1, further comprising means for detecting a position of the mold and for providing a signal to the controlling means so as to cause the ladle to tilt in response to a detection of a predetermined position of the mold.

18. Automatic molten metal pouring apparatus as claimed in claim 1, further comprising an integrating control device interposed between the controlling means and the ladle tilting means, and a poured molten metal quantity detector means for calculating an integrated value of the rate of pouring molten metal and for supplying a corresponding signal to the integrating control device.

19. Automatic molten metal pouring apparatus as claimed in claim 4, wherein an intermediate wall portion of a conical wall of the ancillary pouring cup is inclined or sloped at a smaller grade than a bottom and upper portion of the wall.

20. Automatic molten metal pouring apparatus comprising:

a pot-type ladle, means for applying a pressure to an interior of the ladle, means for controlling the pressure applied to the interior of the ladle so as to control a stream of molten metal poured from the ladle, a pouring cup formed on a mold, means for detecting a locus of a stream of poured molten metal from the pot-type ladle, means for positioning the ladle relative to the mold, and control means operatively connected with said positioning means and said detecting means for controlling the positioning of the ladle in response to a predetermined variation in the locus of a stream of poured molten metal from the pot-type ladle.

* * * * *